US007999651B2

(12) United States Patent
Yamada et al.

(10) Patent No.: US 7,999,651 B2
(45) Date of Patent: Aug. 16, 2011

(54) PLANAR COIL COMPONENT

(75) Inventors: Minoru Yamada, Tokyo (JP); Shigenori Kato, Tokyo (JP); Kenichi Yamaguchi, Tokyo (JP)

(73) Assignee: TDK Corporation, Tokyo (JP)

( * ) Notice: Subject to any disclaimer, the term of this patent is extended or adjusted under 35 U.S.C. 154(b) by 24 days.

(21) Appl. No.: 12/611,960

(22) Filed: Nov. 4, 2009

(65) Prior Publication Data

US 2010/0123537 A1 May 20, 2010

(30) Foreign Application Priority Data

Nov. 18, 2008 (JP) ..... 2008-294251

(51) Int. Cl.
*H01F 27/30* (2006.01)

(52) U.S. Cl. ..... 336/208; 336/198; 336/192

(58) Field of Classification Search ..... None
See application file for complete search history.

(56) References Cited

U.S. PATENT DOCUMENTS

| | | | | |
|---|---|---|---|---|
| 4,352,081 | A * | 9/1982 | Kijima | 336/198 |
| 4,424,504 | A * | 1/1984 | Mitsui et al. | 336/83 |
| 5,140,291 | A * | 8/1992 | Mulder et al. | 336/198 |
| 6,661,326 | B2 * | 12/2003 | Yeh et al. | 336/208 |
| 7,345,566 | B2 | 3/2008 | Urano | |
| 7,564,335 | B1 * | 7/2009 | Yang | 336/192 |
| 7,701,320 | B2 * | 4/2010 | Iwakura et al. | 336/212 |
| 2008/0100407 | A1 * | 5/2008 | Yamaguchi et al. | 336/192 |

FOREIGN PATENT DOCUMENTS

| | | | |
|---|---|---|---|
| JP | 7-29812 | U | 6/1995 |
| JP | 9-45550 | A | 2/1997 |
| JP | 2006-074006 | A | 3/2006 |

* cited by examiner

*Primary Examiner* — Anh Mai
(74) *Attorney, Agent, or Firm* — Leydig, Voit & Mayer, Ltd.

(57) ABSTRACT

In a plane perpendicular to an axial direction of a winding drum, side legs face each other along an X-direction. A Y-direction is perpendicular to the X-direction. A planar coil component is configured so that a point along the Y-direction, where width of a central leg is maximum along the X-direction is at a plus side of the Y-direction, in relation to a center of the Y-direction, of the central leg; width of the central leg along the X-direction monotonically decreases from the point; width of the central leg along the X-direction is longer than along the X-direction; distance between facing surfaces of the side legs is constant; the terminal board is on the minus side, along the Y-direction, of a flange; and an end of the winding extends through the flange at the minus side of the Y-direction.

10 Claims, 3 Drawing Sheets

PLANAR COIL COMPONENT

BACKGROUND OF THE INVENTION

1. Field of the Invention

The present invention relates to a planar coil component used as a choke coil or a transformer (e.g., a flyback transformer used in a flyback power supply), etc.

2. Description of the Related Art

Planar choke coils or planar transformers, whose direction of winding axis of a bobbin is horizontal and which can easily be made thin, are used in power supplies of flat panel televisions etc. A high-frequency transformer disclosed in the patent document (Japanese Patent Application Laid-Open No. 9-45550) intends to get sufficient insulation effect and creepage distance between coils and a core (paragraph [0004]). In the high-frequency transformer, coils are composed by giving windings between flanges of a bobbin with flanges, and the winding ends are bound to terminals respectively. An insulative cover is put on the bobbin with flanges from upper part, and after that ferrite cores are inserted to the bobbin with flanges from both sides. The patent document said that the high-frequency transformer is such a composition that the creepage distance between the windings and the side legs of the ferrite cores are longer than thickness of the insulative cover and it allows to omit troublesome work for wrapping insulative tape, therefore the high-frequency transformer can easily be made compact and thin (paragraph [0018]).

The high-frequency transformer disclosed in the patent document is such composition that the creepage distance between the coil (winding) and the core is given by the insulative cover, therefore the insulative cover is essential. On the other hand, from the point of view of reducing parts, it is desirable that the creepage distance can sufficiently be given without the insulative cover.

SUMMARY OF THE INVENTION

The present invention has been made in view of the foregoing circumstances and problems, and an object thereof is to provide a planar coil component which can get sufficient creepage distance between a winding end and a magnetic core without an insulative cover.

An embodiment of the present invention relates to a planar coil component. The planar coil component includes: a bobbin which has a winding drum, flanges respectively on both sides of the winding drum, a terminal board on at least one of the flanges, and a terminal sticking out from the terminal board; a magnetic core which has an end surface part, a pair of side legs sticking out from both ends of the end surface part, and a central leg sticking out between the side legs from the end surface part, the central leg is inserted into the bobbin and the side legs surround the bobbin; and a winding which is given to the winding drum of the bobbin and whose end is electrically connected to the terminal. In a plane perpendicular to an axial direction of the winding drum, an X-direction is a direction in which the side legs face each other and a Y-direction is perpendicular to the X-direction. A point of the Y-direction where width of the X-direction of the central leg is maximum is at a plus side of the Y-direction in relation to center of the Y-direction of the central leg, and width of the Y-direction of the central leg is longer than width of the X-direction of the central leg. Within predetermined distance from an end of a minus side of the Y-direction, distance between facing surfaces of the side legs is constant or the distance become longer toward the minus side of the Y-direction. The terminal board is on the minus side of the Y-direction of the flange. An end of the winding is put out through the minus side of the Y-direction of the flange to outside.

In the planar coil component according to the embodiment, the central leg may be such form that a section perpendicular to the axial direction of the winding drum is between a triangular shape and an ovoid shape.

In the planar coil component according to the embodiment, the facing surfaces of the side legs may be perpendicular to the X-direction.

Moreover, the side legs may be such form that corners of the minus side of the Y-direction on the facing surfaces are cut off.

In the planar coil component according to the embodiment, a section of the winding drum and a section of the central leg may be nearly same shape so that the central leg just fits into inside of the winding drum.

It is to be noted that any arbitrary combination of the above-described structural components as well as the expressions according to the present invention changed among a system and so forth are all effective as and encompassed by the present embodiments.

According to the embodiments described above, a point of the Y-direction where width of the X-direction of the central leg is maximum is at a plus side of the Y-direction in relation to center of the Y-direction of the central leg, and width of the Y-direction of the central leg is longer than width of the X-direction of the central leg, therefore the creepage distance between the winding end and the magnetic core can be made longer compared with the case where a section of the central leg is circular. And within predetermined distance from an end of a minus side of the Y-direction, distance between facing surfaces of the side legs is constant or the distance become longer toward the minus side of the Y-direction, therefore the creepage distance between the winding end and the magnetic core can be made longer compared with the case where the facing surfaces of the side legs curve to be parallel to the central leg at the minus side of the Y-direction. Moreover, an insulative cover is not needed to get necessary creepage distance.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, the drawings in which.

DETAILED DESCRIPTION OF THE INVENTION

The invention will now be described based on the following embodiments which do not intend to limit the scope of the present invention but exemplify the invention. All of the features and the combinations thereof described in the embodiments are not necessarily essential to the invention.

Figure 1A:
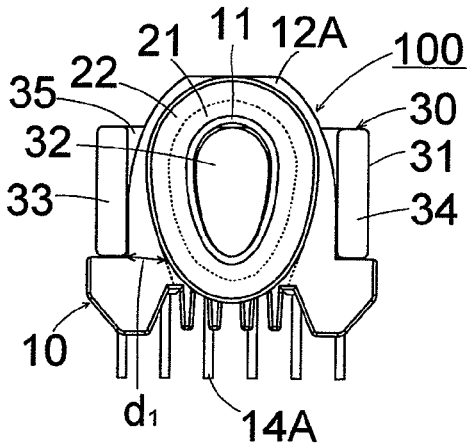
FIG. 1A is an elevation view of a planar coil component according to an embodiment of the present invention cut at a center of an axial direction of a winding drum.
Figure 1D:
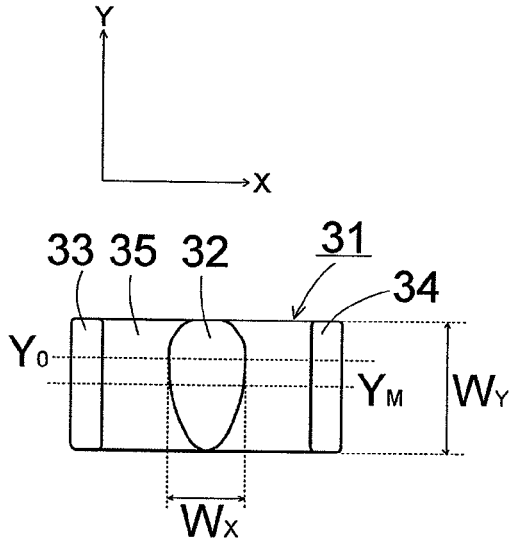
FIG. 1D is an elevation view of an E-type core used in the planar coil component.
Figure 1B:
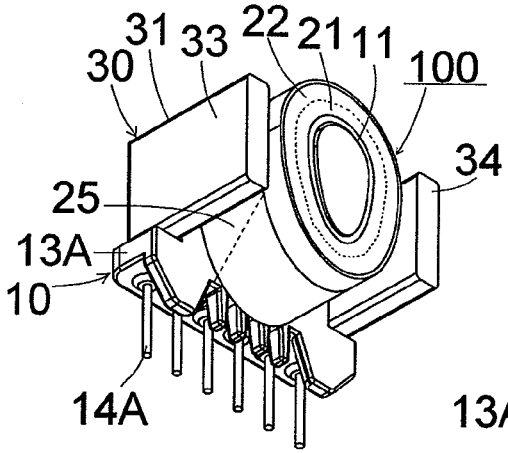
FIG. 1B is a front perspective view of the planar coil component cut the same
Figure 1E:
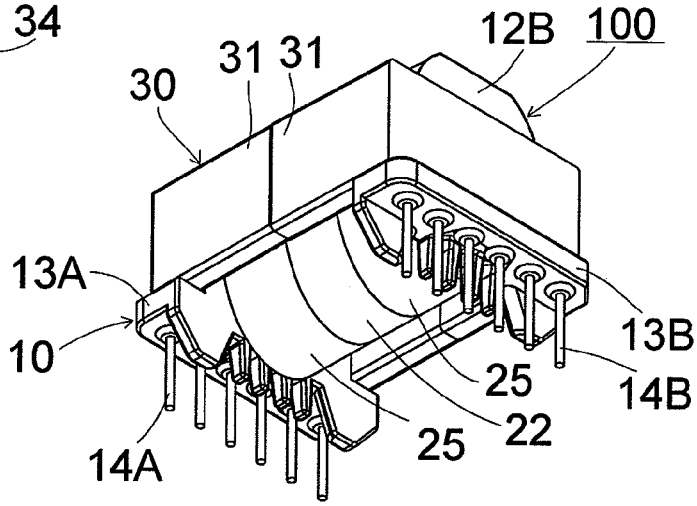
FIG. 1E is a perspective view showing a whole composition of the planar coil component.
Figure 1C:
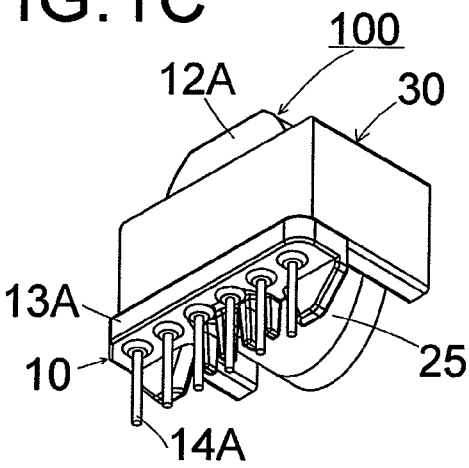
FIG. 1C is a back perspective view of the planar coil component cut the same.

FIG. 1A is an elevation view of a planar coil component 100 according to an embodiment of the present invention cut at a center of an axial direction of a winding drum 11, FIG. 1B is a front perspective view of the planar coil component 100 cut the same, FIG. 1C is a back perspective view of the planar coil component 100 cut the same, FIG. 1D is an elevation view of an E-type core 31 used in the planar coil component 100, and FIG. 1E is a perspective view showing a whole composition of the planar coil component 100.

The planar coil component 100 has a bobbin 10, a primary winding 21, a secondary winding 22, and a magnetic core 30. The bobbin 10 has a winding drum 11, flanges 12A, 12B, terminal boards 13A, 13B, and terminals 14A, 14B.

The flanges 12A, 12B are on both sides of the winding drum 11. The terminal boards 13A, 13B are on the flanges 12A, 12B. The terminals 14A, 14B stick out from the terminal boards 13A, 13B to downside. The terminals 14A, 14B are for example copper or copper alloy (brass, phosphor bronze or the like) or iron (a surface thereof is given coat of copper, tin or the like). The terminals 14A, 14B may be L-pin type terminals. The primary winding 21 and the secondary winding 22 are given to the winding drum 11 and are layered through an insulative tape (not shown) therebetween. Ends of the primary winding 21 and the secondary winding 22 are electrically connected to the terminals 14A, 14B. A barrier tape 25 is winded both sides of the primary winding 21 and the secondary winding 22 to get necessary creepage distance, and an insulative tape (not shown) is winded on the secondary winding 22 (an outer winding) and the barrier tape 25.

The magnetic core 30 is for example a combination of two E-type cores 31 (see FIG. 1D) of ferrite or the like. Each E-type core 31 has a central leg 32, side legs 33, 34, and an end surface part 35. The side legs 33, 34 stick out from both ends of the end surface part 35. The central leg 32 sticks out between the side legs 33, 34 from the end surface part 35. Each central leg 32 of the two E-type cores 31 is inserted into the bobbin 10, and the side legs 33, 34 thereof are face-to-face with each other so that they surround the bobbin 10 with the end surface part 35 to be closed magnetic path.

Hereafter, shape of the E-type cores 31 is more precisely explained. Note that in a plane perpendicular to an axial direction of the winding drum 11, an X-direction is a direction in which the side legs 33, 34 face each other and a Y-direction is perpendicular to the X-direction.

A point $Y_0$ of the Y-direction where width of the X-direction of the central leg 32 is maximum is at a plus side of the Y-direction in relation to center $Y_M$ of the Y-direction of the central leg 32. Width of the X-direction of the central leg 32 monotonically decreases from the point $Y_0$ toward a plus side and a minus side of the Y-direction, and the decreasing rate thereof become high toward the plus side and the minus side of the Y-direction. Width $W_Y$ of the Y-direction of the central leg 32 is longer than width $W_X$ of the X-direction of the central leg 32. Preferably, the central leg 32 is such form that a section perpendicular to the axial direction of the winding drum 11 is an ovoid shape and symmetry with respect to the Y-direction. Note that a section of the winding drum 11 and a section of the central leg 32 are nearly same shape so that the central leg 32 just fits into inside of the winding drum 11. Facing surfaces (inside surfaces) of the side legs 33, 34 are perpendicular to the X-direction, therefore distance between the facing surfaces of the side legs 33, 34 is constant.

The terminal boards 13A, 13B are on the minus side of the Y-direction of the flanges 12A, 12B. Ends of the primary winding 21 and the secondary winding 22 are put out through the minus side of the Y-direction of the flanges 12A, 12B to outside in the axial direction of the winding drum 11 and are electrically connected to the terminals 14A, 14B by for example binding and soldering.

Figure 2A:
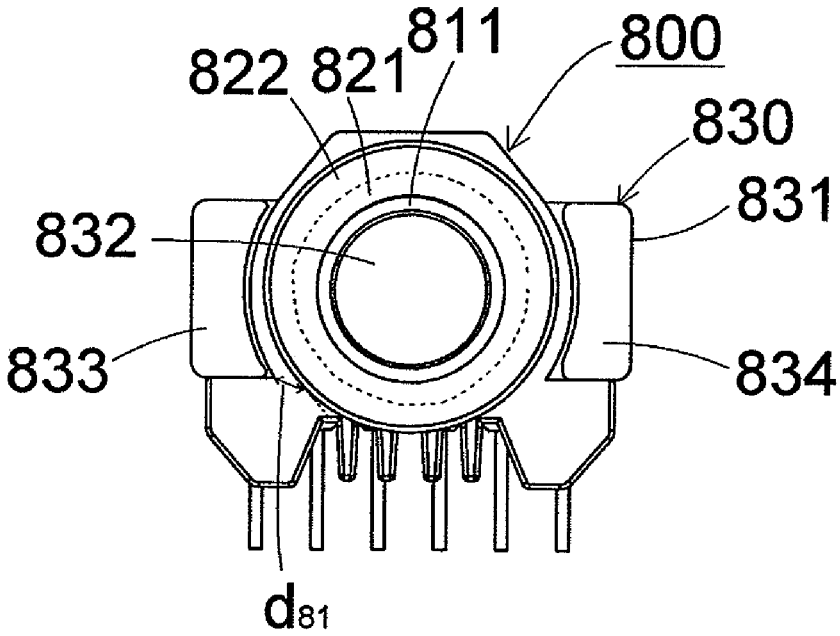
FIG. 2A is an elevation view of a planar coil component of a comparative example cut at a center of an axial direction of a winding drum.
Figure 2B:
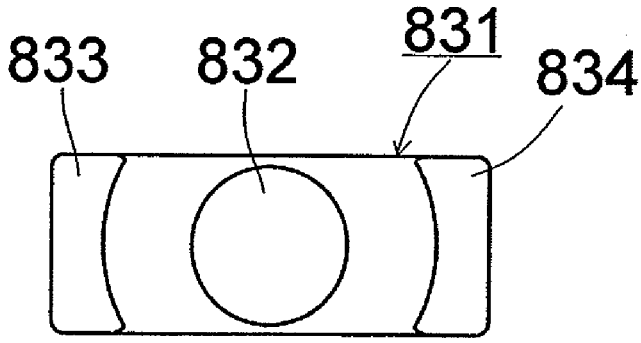
FIG. 2B is an elevation view of an E-type core used in the planar coil component of the comparative example.

According to the planar coil component 100 of the embodiment, a point $Y_0$ of the Y-direction where width of the X-direction of the central leg 32 is maximum is at a plus side of the Y-direction in relation to center $Y_M$ of the Y-direction of the central leg 32; width of the X-direction of the central leg 32 monotonically decreases from the point $Y_0$ toward a plus side and a minus side of the Y-direction; the decreasing rate thereof become high toward the plus side and the minus side of the Y-direction; width $W_Y$ of the Y-direction of the central leg 32 is longer than width $W_X$ of the X-direction of the central leg 32; and the section of the winding drum 11 and the section of the central leg 32 are nearly same shape so that the central leg 32 just fits into inside of the winding drum 11, therefore creepage distance between the magnetic core 30 and the ends of the primary winding 21 and the secondary winding 22 can be made longer compared with a comparative example explained in FIGS. 2A and 2B where the section of the central leg is circular if size of cross-sectional area of the central leg (size of cross-sectional area perpendicular to the axial direction of the winding drum 11) is same. Moreover, the facing surfaces (inside surfaces) of the side legs 33, 34 are perpendicular to the X-direction, therefore the creepage distance $d_1$ between the magnetic core 30 and the ends of the primary winding 21 and the secondary winding 22 can be made sufficiently long (e.g. 8.0 mm) compared with the comparative example explained in FIGS. 2A and 2B where the facing surfaces of the side legs curve to be parallel to the central leg at the minus side of the Y-direction.

The comparative example is explained to clarify effects of the embodiment.

FIG. 2A is an elevation view of a planar coil component 800 of the comparative example cut at a center of an axial direction of a winding drum 811, and FIG. 2B is an elevation view of an E-type core 831 used in the planar coil component 800 of the comparative example. Mainly, differences between the planar coil component 800 of the comparative example and the planar coil component 100 of the embodiment are explained.

A section of a central leg 832 perpendicular to the axial direction of the winding drum 811 is circular. Facing surfaces of side legs 833, 834 entirely curve to be a cylindrical surface parallel to the central leg 832. In this case, the creepage distance $d_{81}$ between a magnetic core 830 and ends of a primary winding 821 and a secondary winding 822 is at most 4.0 mm, not sufficient.

Comparison with the comparative example also makes it clear that creepage distance between a winding end and a magnetic core can be made sufficiently long according to the embodiment. Moreover, an insulative cover is not needed to get necessary creepage distance, therefore it is possible to meet demands to reduce parts.

Described above is an explanation based on the embodiments. The description of the embodiments is illustrative in nature and various variations in constituting elements and processes involved are possible. Those skilled in the art would readily appreciate that such variations are also within the scope of the present invention.

Figure 3A:
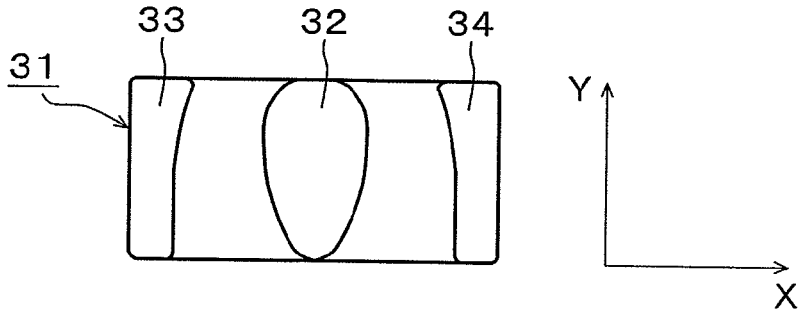
FIG. 3A to FIG. 3D are elevation views of an E-type cores of other embodiments.
Figure 3B:
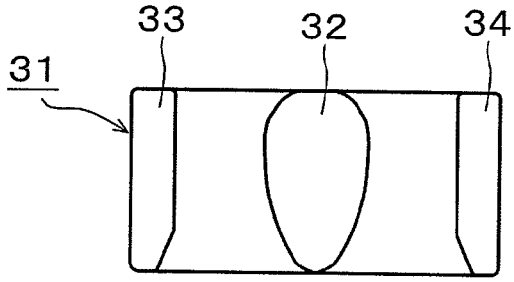
Figure 3C:
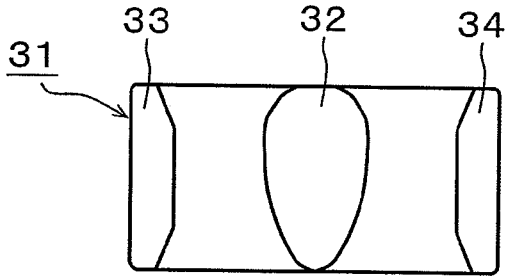

While the facing surfaces of the side legs 33, 34 of the E-type core 31 are perpendicular to the X-direction in the embodiment, the facing surfaces of the side legs 33, 34 at a plus side (a side where the winding end is not put out) of the Y-direction may curve to be parallel (or to become near parallel) to the central leg 32 as shown in FIG. 3A. Namely, it is only necessary that the facing surfaces of the side legs 33, 34 are perpendicular to the X-direction (in other words, distance between the facing surfaces of the side legs 33, 34 is constant) within predetermined distance from an end of a minus side of the Y-direction. Note that "within predetermined distance" is for example "in a range near the minus side of the Y-direction in relation to position between the point $Y_0$ of the Y-direction where width of the X-direction of the central leg 32 is maximum and the center $Y_M$ of the Y-direction of the central leg 32". Moreover, the side legs 33, 34 may be such form that corners of the minus side of the Y-direction on the facing surfaces are cut off as shown in FIG. 3B. Namely, distance between the facing surfaces of the side legs 33, 34 may become longer toward the minus side of the Y-direction within predetermined distance from the end of the minus side of the Y-direction. This makes it possible to get further long creepage distance between the winding end and the magnetic core. Optionally the side legs 33, 34 may be such form that corners of both sides of the Y-direction on the facing surfaces are cut off as shown in FIG. 3C.

Figure 3D:
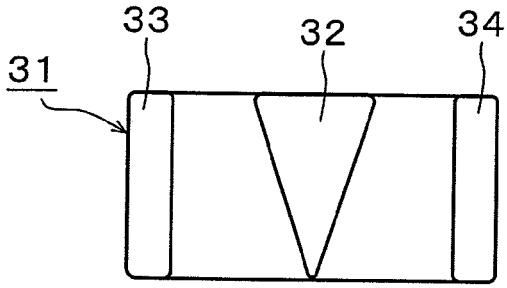

While the section of the central leg 32 perpendicular to the axial direction of the winding drum 11 is an ovoid shape in the embodiment, the section may be a triangular shape as shown in FIG. 3D. Note that corners of the triangular shape may be chamfered or rounded.

While the planar coil component is a transformer in the embodiment, the planar coil component may be a choke coil.

What is claimed is:

1. A planar coil component comprising:

a bobbin including a winding drum having an axial direction and a central opening, first and second flanges extending from respective, opposite sides of the winding drum, transverse to the axial direction of the winding drum, a terminal board located on at least one of the flanges, and a terminal protruding from the terminal board;

a magnetic core including an end surface, first and second side legs protruding transverse to and from opposite ends of the end surface, and a central leg protruding transverse to and from the end surface and located centrally between the first and second side legs, wherein the central leg is located within the central opening of the winding drum of the bobbin and the first and second side legs are located at opposite sides of the winding drum of the bobbin, along a direction transverse to the axial direction of the winding drum; and a winding wound on the winding drum of the bobbin and having an end electrically connected to the terminal, wherein, when a plane perpendicular to the axial direction of the winding drum includes an X-direction perpendicular to the first and second side legs and a Y-direction perpendicular to the X-direction, with an X-axis centrally located with respect to the first and second side legs, along the X-direction, and a Y-axis centrally located with respect to the central leg along the Y-direction and intersecting the axial direction of the winding drum, then the central leg is widest along the X-direction position on the Y-axis that is located on a first side of the X-axis, the central leg is longer along the Y-direction than along the X-direction, separation between facing surfaces of the first and second side legs, in the X-direction, is constant with respect to the Y-direction, the terminal board is located on the first flange, which is positioned along the Y-direction on a second side of the X-axis which is opposite from the first side of the X-axis, and the end of the winding extends through and outside the first flange, in the Y-direction, on the second side of the X-axis.

2. The planar coil component according to claim 1, wherein the central leg has a shape so that a section, perpendicular to the axial direction of the winding drum, is intermediate a triangular shape and an ovoid shape.

3. The planar coil component according to claim 1, wherein the facing surfaces of the first and second side legs are perpendicular to the X-direction.

4. The planar coil component according to claim 1, wherein width of the central leg of the magnetic core along the X-direction decreases, from the position on the Y-axis where the central leg is widest, more rapidly with distance along the Y-axis toward the second side of the X-axis than in an opposite direction along the Y-axis, toward the first side of the X-axis.

5. The planar coil component according to claim 1, wherein a section of the winding drum and a section of the central leg are nearly identical in shape so that the central leg fits inside of the winding drum.

6. A planar coil component comprising:

a bobbin including a winding drum having an axial direction and a central opening, first and second flanges extending from respective, opposite sides of the winding drum, transverse to the axial direction of the winding drum, a terminal board located on at least one of the flanges, and a terminal protruding from the terminal board;

a magnetic core including an end surface, first and second side legs protruding transverse to and from opposite ends of the end surface, and a central leg protruding transverse to and from the end surface and located centrally between the first and second side legs, wherein the central leg is located within the central opening of the winding drum of the bobbin and the first and second side legs are located at opposite sides of the winding drum of the bobbin, along a direction transverse to the axial direction of the winding drum; and a winding wound on the winding drum of the bobbin and having an end electrically connected to the terminal, wherein, when a plane perpendicular to the axial direction of the winding drum includes an X-direction perpendicular to the first and second side legs and a Y-direction perpendicular to the X-direction, with an X-axis centrally located with respect to the first and second side legs, along the X-direction, and a Y-axis centrally located with respect to the central leg along the Y-direction and intersecting the axial direction of the winding drum, then the central leg is widest along the X-direction at a position on the Y-axis that is located on a first side of the X-axis, the central leg is longer along the Y-direction than along the X-direction, separation between facing surfaces of the first and second side legs, in the X-direction, becomes larger along the Y-direction, toward the second side of the X-axis, which is opposite from the first side of the X-axis, the terminal board is located on the first flange which is positioned along the Y-direction on the second side of the X-axis, and the end of the winding extends through and outside the first flange, in the Y-direction, on the second side of the X-axis.

7. The planar coil component according to claim 6, wherein corners of the first and second side legs on the facing surfaces are truncated, in the X-direction, on the second side of the X-axis.

8. The planar coil component according to claim 6, wherein the central leg has a shape so that a section, perpendicular to the axial direction of the winding drum, is intermediate a triangular shape and an ovoid shape.

9. The planar coil component according to claim 6, wherein a section of the winding drum and a section of the central leg are nearly identical in shape so that the central leg fits inside of the winding drum.

10. The planar coil component according to claim 6, wherein width of the central leg of the magnetic core along the X-direction decreases, from the position on the Y-axis where the central leg is widest, more rapidly with distance along the Y-axis toward the second side of the X-axis than in an opposite direction along the Y-axis, toward the first side of the X-axis.

* * * * *